US007658036B2

(12) United States Patent
Banks et al.

(10) Patent No.: US 7,658,036 B2
(45) Date of Patent: Feb. 9, 2010

(54) SELF-CLEANING GUTTER COVER

(75) Inventors: Robert LaVerne Banks, Noblesville, IN (US); Jonathan Wayne Wallace, Noblesville, IN (US); Joseph Wendell Pettijohn, Noblesville, IN (US); Jonathan Wayne Wallace, II, Noblesville, IN (US)

(73) Assignee: Premier Gutter Cover LLC, Clackamas, OR (US)

( * ) Notice: Subject to any disclaimer, the term of this patent is extended or adjusted under 35 U.S.C. 154(b) by 382 days.

(21) Appl. No.: 10/745,309

(22) Filed: Dec. 24, 2003

(65) Prior Publication Data

US 2005/0166465 A1 Aug. 4, 2005

(51) Int. Cl.
*E04D 13/00* (2006.01)

(52) U.S. Cl. ..... 52/12; 52/15; 248/48.1

(58) Field of Classification Search ..... 52/12, 52/11, 15, 537, 13, 14, 16; 248/48.1, 48.2
See application file for complete search history.

(56) References Cited

U.S. PATENT DOCUMENTS 503,173 A * 8/1893 Spahmer, Jr. ..... 52/531
1,343,461 A * 6/1920 Marberg ..... 52/11
1,900,749 A * 3/1933 Slakdy ..... 138/168
2,734,467 A * 2/1956 Steele ..... 52/12
2,851,133 A * 9/1958 Steele ..... 52/666
3,420,378 A * 1/1969 Turner ..... 210/474
3,630,383 A * 12/1971 Reeves ..... 210/404
4,307,976 A * 12/1981 Butler ..... 405/118
4,987,716 A * 1/1991 Boyd ..... 52/520
5,072,551 A * 12/1991 Manoogian, Jr. ..... 52/12
5,216,851 A * 6/1993 Kuhns ..... 52/12
5,956,904 A * 9/1999 Gentry ..... 52/12
2003/0046876 A1* 3/2003 Higginbotham ..... 52/11

* cited by examiner

*Primary Examiner*—Richard E Chilcot, Jr.
*Assistant Examiner*—William V Gilbert
(74) *Attorney, Agent, or Firm*—McKee, Voorhees & Sease, P.L.C.

(57) ABSTRACT

The Premier Gutter Cover is a combination of flat metal sheeting and expanded metal so as to give adequate water control, and yet keep leaves and debris from entering the gutter system on a structure. Downward water flow is slowed by the near-flat installation of the cover, further disbursed and slowed by the V-groove rib, and yet further disbursed and slowed by the roll-front of the double-interlock of the flat sheet to expanded metal. Finally, the water is collected into the gutter system through the expanded metal section as it washes leaves and debris over the front edge of the gutter.

9 Claims, 3 Drawing Sheets

SELF-CLEANING GUTTER COVER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING A TABLE OR A COMPUTER PROGRAM LISTING COMPACT DISK APPENDIX

Not Applicable

BACKGROUND OF THE INVENTION

The general purpose of a rain gutter cover is to prevent leaves and debris from entering rain gutter and downspout systems, while allowing free flow of rain water through the same.

There are many types of screens, hoods & inserts which attempt to accomplish the above, but they all have their faults.

The two most popular coverings are screens (wire or expanded metal) and full hoods with an exposed, unprotected opening across the full vertical front of the hood.

Screens allow the water to pass through from the very beginning, but by the time the water passes over approximately the first 1" of screening, it has all entered the gutter system, causing the front of the screening to eventually clog with leaves and debris because there is no water left to wash it clean. Eventually, the clogging backs up, covering even the first 1" of the screening causing water to overflow the front, and sometimes the back, of the gutter. In time this build-up on the screening mulches and sifts through the screening and even plugs the gutter system, compounding the problem.

Hoods, on the other hand, keep most leaves and debris from entering the gutter system because they are constructed of solid material. The front edge of a hood is rounded, with an unprotected horizontal opening across the bottom. The water travels downward across the hood and clings to the rounded front, flowing into the front opening, while washing much of the leaves and debris over the front. However, soft leaves and debris can, and do, also follow the front contour of the hood with the water, thus entering the gutter system. Also, hoods that slip between layers of roofing can not be installed on homes with rigid roofing that extends down to the top of the gutter. This would cause a backward tilt to the hood, as the front of the hood would stand up higher than the back because of the rolled vertical front. Other hoods stand taller, requiring the back to lay on the roofing one to two tabs up the roof. When this type is installed on rough wood shakes it creates an unsightly and uneven back/top edge, allowing leaves and debris to snag on this edge as they attempt to wash down onto the hood.

BRIEF SUMMARY OF THE INVENTION

This invention is comprised of a solid sheet of metal with a V-groove through it's near-center. The V-groove serves to help strengthen the flat sheet, while giving a perfect place to bend the gutter cover to match the pitch of the roof of the home being installed on. The flat sheet is typically finished to 4 ft. wide by 5½" deep, attached to a finished size expanded metal sheet 4' wide by 1½" deep by using a double-interlock fold. The front edge is trimmed with ½" matching solid sheet metal, and the cover is attached to the gutter front with easy-off snap-lock clips. The left-front edge is notched for easy overlapping of gutter cover sections.

The rain water from the roof is slowed and spread by the V-groove, then slowed more by the near-flat front section of the flat sheet. The water then begins to cling to the small rounded front of the Double-interlock seam, and enters the 1" exposed section of expanded metal, while washing most leaves and debris over the front of the gutter system.

THE SEVERAL VIEWS OF THE DRAWINGS

See 3–page attachment plus cover sheet.

DETAILED DESCRIPTION OF THE INVENTION

This new rain gutter cover is not a hood or a screen. It is an entirely new concept.

The Premier Gutter Cover is a combination of (A) the best features of a gutter hood and (B) the best features of gutter screening, and eliminating the problems found in each.

Because this cover lays almost flat, it can be installed on homes with rigid roofs that extend down to the top of the gutter. When attempting to install solid hoods with a front horizontal opening on this type roof, it causes the hood top to have a reverse pitch forcing water back under the shingles and sometimes into the house. Also leaves and debris will not wash off with a reverse top pitch.

There are gutter covers of various sorts that are of solid material with punched holes of different shapes, some of which lay flat or near-flat over the top of the gutter. But the edges of the punched holes tend to snag some leaves or debris. There are also too many holes or openings, allowing all water to enter the gutter before the leaves and debris are washed off. Using only about 1" of exposed and properly "crowned" expanded metal 12, inhibits snagging. Leaves and debris tend to wash over the crowned edges of the expanded metal 12 for the first 1".

Figure 1:
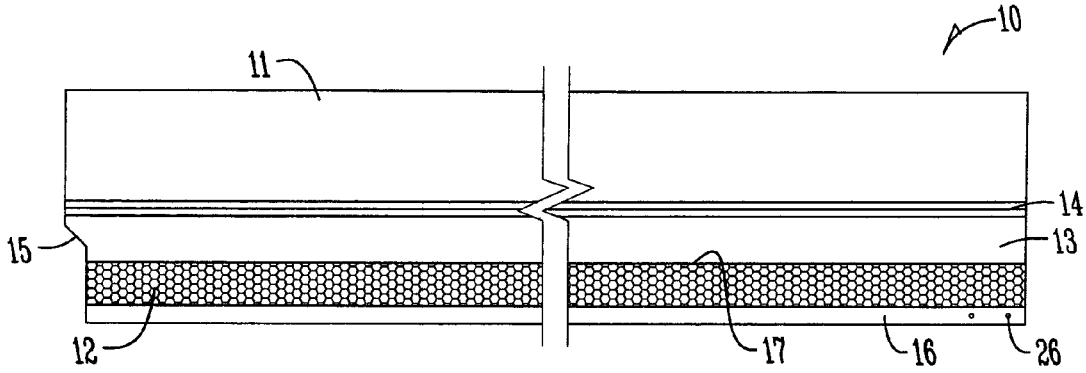
FIG. 1 is a top view of the gutter cover of the invention.

By using a solid cover 11, as shown in FIG. 1, over most of the gutter 30, this new cover 10 keeps out virtually all of the leaves and debris, and, when it is raining, forces the leaves and debris forward, off of the solid section 11.

Figure 3:
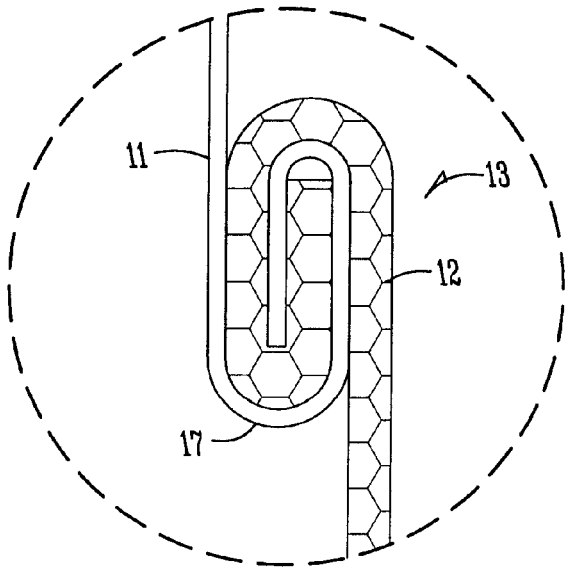
FIG. 3 is a cross-sectional enlargement of the double-interlock fold of the gutter cover of the invention.
Figure 4:
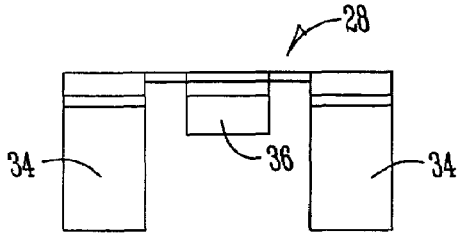
FIG. 4 is a top view of the gutter cover clip of the invention.
Figure 7:
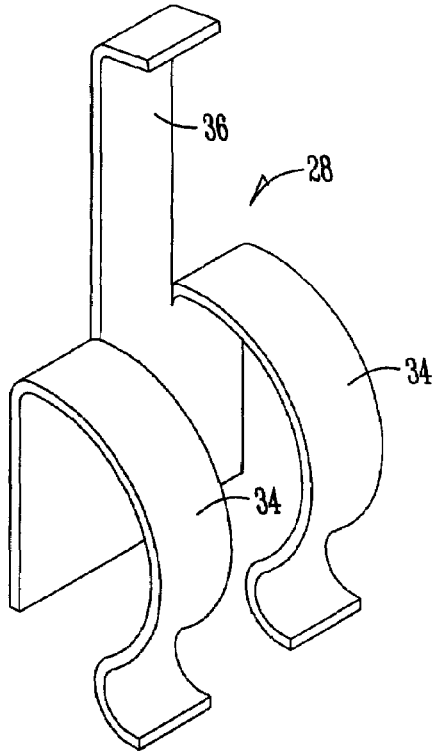
FIG. 7 is a perspective rear view of the gutter cover clip of the invention.
Figure 5:
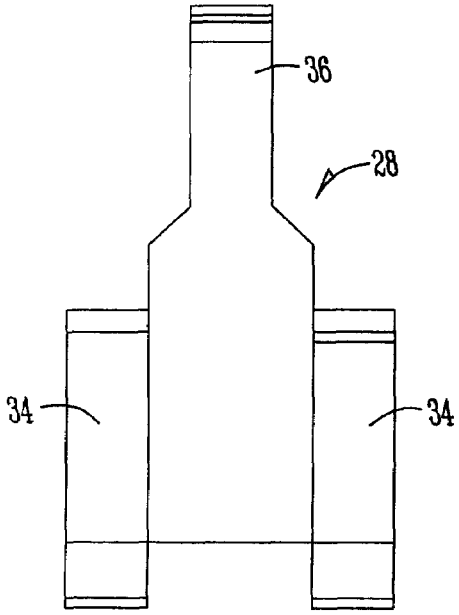
FIG. 5 is a front view of the gutter cover clip of the invention.
Figure 6:
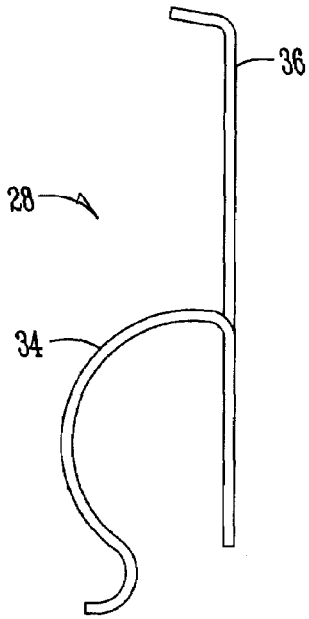
FIG. 6 is a right side view of the gutter cover clip of the invention.

The roll-front edge 17 of the double-lock seam 13 (FIG. 3) connecting the solid sheet 11 to expanded metal 12 (FIG. 1), forces the water downward to help begin it's entry into the gutter system 30. This double-lock seam 13 also serves as a very strong strengthening rib.

When the water reaches the expanded metal section 12 it continues to push the leaves and debris across the expanded metal 12 and off the front of the gutter 30 thus becoming a self-cleaning action, because only 1" of expanded metal 12 is exposed to the gutter 30 trough-enough to catch all of the water, but no excess to catch the leaves and debris. By the time the leaves and debris are washed off the front, the water has entered the gutter system 30 through the expanded metal 12 solving both the problem with the open front hood, and the leaf/debris buildup and clogging of a full screen.

Figure 2:
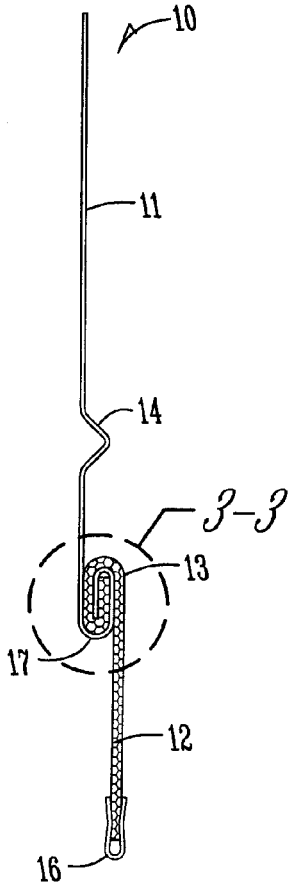
FIG. 2 is a side view of the gutter cover of the invention.

As roof pitches require, the hooded section can be bent at the V-groove rib 14 (FIG. 1 & FIG. 2) allowing for easier installation. This V-groove rib 14 also serves as a rear strengthening rib for added stability and a water distributor.

Figure 8:
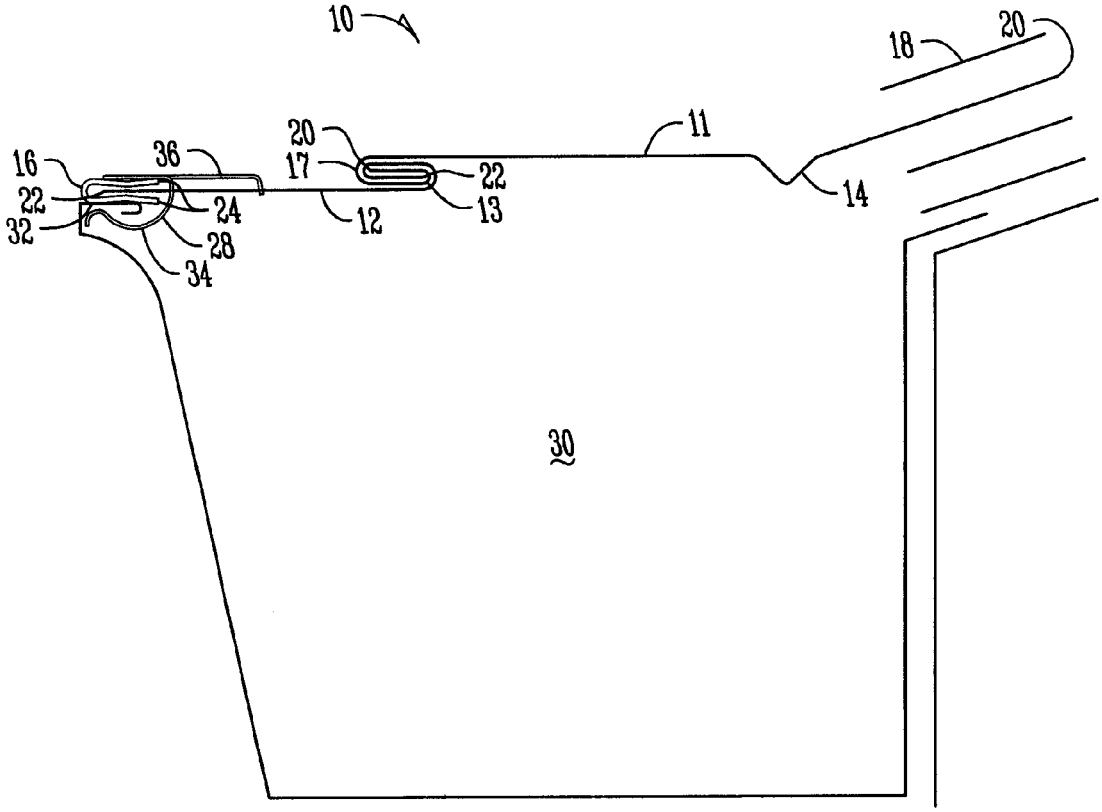
FIG. 8 is a cross-sectional view of the gutter cover and gutter cover clip of the invention that has been installed on a gutter.

This new cover is installed by slipping the back edge between the layers of roofing 18—EVEN WOOD AND SLATE—giving a smooth, flat, neat-appearing finish, (FIG. 8) allowing water, leaves, and debris to flow onto the cover without problem.

The front edge 22 of the expanded metal 12 has a front trim 16 (FIG. 1 for stability and appearance.

The front edge 22 is secured by means of stainless steel clips 28 (FIG. 7) which are pre-attached to the gutter cover 10 through pairs of holes 26 (FIG. 1) punched in the front trim 16. The clip 28, as best illustrated in FIGS. 4-7, is formed having an upper thumb tab 36 for securing to the expanded metal 12 and a pair of lower clip fingers 34 extending away from and parallel to the thumb tab 36 for securing cover 10 to the front edge 32 of the gutter 10 by inserting the pair of lower clip fingers 34 through crimp punch holes 26 such that the pair of lower clip fingers 34 snap onto folded solid sheet 16 and snap-lock under the front edge 32 of the gutter 10.

Each succeeding cover 10 is joined by overlapping the right side of the cover 10 over the left-notched side 15 (FIG. 1) of the joining cover 10, thus creating a ⅝" overlap for seal and strength.

Specifications:

1. Solid sheet 11
   0.019 aluminum or steel
   painted or mill finish
   48"×6¾"
2. Expanded metal 12
   0.034 aluminum or steel
   painted or mill finish
   48"×3¾"
   slits expanded to ¼" openings
   moderately crowned
3. Double interlock seam 13
   first fold ⅜"
   second fold ¾"
4. V-groove rib 14
   ½×⅛" across 48" length
   front beginning 3¾" from front edge of finished cover
5. Notch for overlapping covers 15
   left side–front edge–2¼" deep×⅝" wide
6. Front cap (folded solid sheet) 16
   48"×1"×0.019"
   matching flat sheet
   folded in half and crimped over front edge of expanded metal front to make ½" front trim edge
7. Finished size of Premier Gutter Cover—48"×7" 10

Alternative to being made from metals as specified above, the alternate embodiments of the gutter cover 10 herein may be made from a suitable plastic, such as PVC, and shaped as shown, in one piece, by suitable plastic shaping techniques known to the art.

It will be apparent that modifications may be made to the invention without departing from the spirit and scope of the invention; accordingly, what is sought to be protected is set forth in the "CLAIMS".

What we claim as our invention is:

1. A self-cleaning gutter cover for installation over a gutter attached to a roof and having a back edge, a front edge, a trough defined between the back and the front edge, and the back and front edges and opening to the trough being collinear with a first plane, the self-cleaning gutter cover comprising:

a metal sheet having terminal parallel edges, the metal sheet extending from the back edge of the gutter towards the front edge of the gutter beyond a midpoint of the trough to assist in carrying water and debris forward overtop the trough beyond the midpoint;

a groove in said metal sheet, the groove:

a) running parallel between the edges of the metal sheet and positioned between the back edge and the midpoint of the trough;

b) providing a bending point to assist in matching the metal sheet to both pitch of the roof and the gutter;

c) to assist in leveling a portion of the metal sheet for slowing water passing overtop the metal sheet;

an expanded metal strip connected to the other parallel edge of the metal sheet overtop the trough and between the midpoint and the front edge, the flat expanded metal strip extending forward from beyond the midpoint to the front edge of the trough to assist in separating debris from the water and to provide for self-cleaning of debris from off the flat expanded metal strip;

an opposite edge of the expanded metal strip capped with a folded sheet; and wherein the expanded metal strip lies substantially in the first plane collinear with the front and back edge and opening of the gutter.

2. The invention as described in claim 1 wherein one edge of the metal sheet extends rearward of the back edge of the gutter and the other edge is wrapped together with the flat expanded metal strip to form a seam, the seam positioned between the midpoint and front edge of the trough and has a downwardly oriented face to assist in transitioning water onto the flat expanded metal strip.

3. The invention as described in claim 1 wherein the folded sheet is fastened to the front edge of the gutter by a clip, the clip having a pair of lower clip fingers attached to an upper thumb tab, wherein the pair of lower clip fingers extend generally outward and parallel to the upper thumb tab to provide a space between the upper thumb tab and pair of lower clip fingers, the gutter cover set in place over the gutter and the pair of lower clip fingers being inserted through holes in the flat expanded metal strip, said pair of lower clip fingers being pressed downward through said holes in the flat expanded metal strip and toward the front edge of the gutter until said pair of lower clip fingers snap under the front edge of the gutter so that the folded sheet is received within the space between the pair of lower clip fingers and the upper thumb tab, the upper thumb tab being pressed downward into said flat expanded metal strip to assist in locking said clip to said gutter cover and said gutter cover to said gutter.

4. The invention as described in claim 1 wherein each gutter cover includes a notch on one parallel edge, the notch extends from the folded sheet into the metal sheet to assist in overlapping with another section of the self-cleaning gutter cover.

5. A self-cleaning gutter cover for installation over a gutter attached to a roof and having a back edge, an opposite front edge, a trough defined between the back and front edge, and the trough having an opening occupying a first plane collinear with edges of the gutter, the self-cleaning gutter cover comprising:

a solid metal sheet having a solid surface defined between terminal first and second parallel edges, the solid metal sheet being substantially collinear with a second plane, the solid metal sheet extending rearward over the back edge of the gutter and forward beyond a midpoint of the trough to assist in keeping water out of the trough;

a flat expanded metal strip having a porous surface area defined between parallel edges, the flat expanded metal strip being substantially collinear with a third plane, the flat expanded metal strip having holes to pass water into the gutter and having one edge wrapped together with the second edge of the solid metal sheet to form a connection positioned between the midpoint and the front edge of the trough, the connection having a downwardly oriented rounded front edge to assist in transitioning water downward from the solid metal sheet on top of the flat expanded metal strip to collect in the gutter;

a groove in the solid metal sheet, and the groove between the first edge and the midpoint of the gutter to provide a bending point to assist in matching the solid metal sheet with the gutter and pitch of the roof to assist in slowing and evenly distributing water before passing onto the flat expanded metal strip; and wherein the second plane occupied by the solid metal sheet is substantially parallel with the third plane occupied by the flat expanded metal strip to thereby provide for self-cleaning;

wherein the solid metal sheet extends from the back edge towards the front edge beyond the midpoint of the trough so as to be substantially collinear with the first plane occupied by the opening of the trough to assist in carrying water overtop the trough at least past the midpoint to limit the porous surface area of the flat expanded metal strip covering the trough to thereby provide for self-cleaning and prevent leaves and debris from accumulating on and clogging the flat expanded metal strip.

6. The gutter cover of claim 5 wherein the flat expanded metal strip extends overtop the trough from beyond the midpoint to the front edge of the gutter being collinear with the third plane and substantially parallel to the first plane occupied by the opening of the trough to limit exposure of leaves and debris to the flat expanded metal strip to thereby control water flow into the gutter thus providing for self-cleaning of debris from the flat expanded metal strip.

7. The gutter cover of claim 5 wherein the solid metal sheet further comprises a first and second solid surface area separated by the groove, the second solid surface area attached to the expanded metal strip, the groove bent during installation by angling the first solid surface area relative to the second solid surface area to thereby assist in positioning the first solid surface area of the solid metal sheet commensurate with the roof pitch and the second solid surface area of the solid metal sheet nearly flat on the gutter to slow water flow before reaching the flat expanded metal strip to control water flow across and into the gutter to provide for self-cleaning.

8. The gutter cover of claim 5 wherein the groove, levelness of the second solid surface, and the downwardly oriented rounded front edge of the connection between the solid metal sheet and flat expanded metal strip assists in slowing and evenly distributing water overtop the flat expanded metal strip to provide self-cleaning of debris from the expanded metal strip.

9. A self-cleaning gutter cover for installation over a gutter attached to a roof and having a back edge, an opposite front edge, a trough defined between the back and front edge, and the trough having an opening occupying a first plane collinear with edges of the gutter, the self-cleaning gutter cover comprising:

a solid metal sheet having a solid surface defined between terminal first and second parallel edges, the solid metal sheet being substantially collinear with a second plane, the solid metal sheet extending rearward over the back edge of the gutter and forward beyond a midpoint of the trough to assist in keeping water out of the trough;

a flat expanded metal strip having a porous surface area defined between parallel edges, the flat expanded metal strip being substantially collinear with a third plane, the flat expanded metal strip having holes to pass water into the gutter and having a first edge wrapped together with the second edge of the solid metal sheet to form a connection positioned between the midpoint and the front edge of the trough, the connection having a downwardly oriented rounded front edge to assist in transitioning water downward from the solid metal sheet on top of the flat expanded metal strip to collect in the gutter;

a groove in the solid metal sheet, and the groove between the first edge and the midpoint of the gutter to provide a bending point to assist in matching the solid metal sheet with the gutter and pitch of the roof to assist in slowing and evenly distributing water before passing onto the flat expanded metal strip;

wherein the second plane occupied by the solid metal sheet is substantially parallel with the third plane occupied by the flat expanded metal strip;

wherein the solid metal sheet extends from the back edge towards the front edge beyond the midpoint of the trough so as to be substantially collinear with the first plane occupied by the opening of the trough to assist in carrying water overtop the trough at least past the midpoint to limit the porous surface area of the flat expanded metal strip covering the trough to thereby provide for self-cleaning and prevent leaves and debris from accumulating on and clogging the flat expanded metal strip; and, a second edge of the expanded metal strip opposite the first edge of the expanded metal strip capped with a folded sheet.

* * * * *